United States Patent [19]

Ohsaki et al.

[11] Patent Number: 4,925,604

[45] Date of Patent: May 15, 1990

[54] PROCESS FOR PREPARING A CARBON FIBER OF HIGH STRENGTH

[75] Inventors: Takashi Ohsaki, Shimada; Koichi Imai; Naomasa Miyahara, both of Fujieda, all of Japan

[73] Assignee: Nikkiso Co., Ltd., Tokyo, Japan

[21] Appl. No.: 787,428

[22] Filed: Oct. 15, 1985

[30] Foreign Application Priority Data

Oct. 16, 1984 [JP] Japan ..... 59-215207

[51] Int. Cl.[5] ..... D01F 9/22

[52] U.S. Cl. ..... 264/29.2; 264/182; 264/206; 264/210.7; 264/210.8; 264/211.15; 264/233

[58] Field of Search ..... 264/29.2, 182, 206, 264/210.8, 210.7, 211.15, 233; 423/447.1

[56] References Cited

U.S. PATENT DOCUMENTS

| | | | |
|---|---|---|---|
| 2,670,268 | 2/1954 | Stanton et al. | 264/182 |
| 2,917,806 | 12/1959 | Spence et al. | 264/182 |
| 3,121,765 | 2/1964 | Kanda et al. | 264/182 |
| 3,485,913 | 12/1969 | Yamada et al. | 264/182 |
| 3,523,150 | 8/1970 | Vigneault | 264/182 |
| 3,904,716 | 9/1975 | Moreton et al. | 264/182 |
| 4,448,740 | 5/1984 | Sawanishi et al. | 264/182 |

FOREIGN PATENT DOCUMENTS 3993877 10/1977 Japan .

*Primary Examiner*—Hubert C. Lorin

*Attorney, Agent, or Firm*—Robert R. Jackson; Leon R. Yankwich

[57] ABSTRACT

A carbon fiber of high strength is disclosed, each filament of which is substantially circular in its cross-section but which has circumferential ruggedness which extends in parallel to an axis of the filament to form pleats. The ruggedness has a depth of more than 0.1 μm.

The carbon fiber is prepared by extruding a spinning solution of an aqueous polyacrylonitrile/pure zinc chloride solution of a specified polymer content into a coagulating bath at a specified draft ratio, followed by washing, drying and stretching at a total stretching ratio of 10–20 folds to form a precursor which is then subjected to conventional stabilizing and carbonizing steps.

3 Claims, 1 Drawing Sheet

PROCESS FOR PREPARING A CARBON FIBER OF HIGH STRENGTH

FIELD OF THE INVENTION

This invention relates to a process for preparing a carbon fiber of high strength having superior mechanical and surface properties.

BACKGROUND OF THE INVENTION

Recently, the carbon fiber has been utilized for advanced composites of plastics, metals or ceramics based on its superior mechanical properties, such as high strength, high modulus and low specific gravity. In particular, carbon fiber reinforced plastics have been practically utilized for various applications, for example, in aerospace planes, automobiles, industrial machines, the leisure industries and others.

In such applications, much higher performance and strength of the carbon fiber has been desired. The term "fiber", as used herein, signifies a continuous long fiber. The carbon fiber previously had a tensile strength of about 300 Kg/mm$^2$ but recently has been improved up to a level of 400 Kg/mm$^2$. Nowadays, a higher strength of 500 Kg/mm$^2$ is required.

However, the carbon fiber having a tensile strength of 500 Kg/mm$^2$ can not be readily prepared by conventional improved methods. And, the commercially available carbon fiber of 400 Kg/mm$^2$ can not give its full performance when used as a composite material.

There is a known process in which acrylonitrile is polymerized in an aqueous concentrated zinc chloride solution to form a polymer solution which is then spinned into an aqueous dilute zinc chloride solution to prepare an acrylic fiber. Practically, in the known process, 5 to 10% of sodium chloride is added to the polymer solution in order to reduce its viscosity. However, the presence of a non-solvent, such as sodium chloride, in the solution decreases stringiness of the solution, resulting in difficulty of obtaining each filament of small diameter. Such a system for producing a carbon fiber from the acrylic fiber is disclosed in Japanese Patent Publication No. 39938/77.

Further, there has been used a process for preparing the acrylic fiber and the carbon fiber from polyacrylonitrile solution in an organic solvent, such as dimethylformamide or dimethylsulfoxide. In this process, however, the single fiber filament of the carbon fiber thus prepared has a somewhat flat cross-section and is difficult to free from the organic solvent. A carbon fiber of high strength can not be obtained (its tensile strength is at most 350 Kg/mm$^2$).

Accordingly, an object of the invention is to provide a carbon fiber having a tensile strength of more than 400 Kg/mm$^2$ and the ability of giving a composite material of high strength.

The conventional methods have utilized various techniques for improving the performance of the composite material, for e.g., (a) preventing incorporation of foreign substances into a precusor during the spinning step or (b) by coating a filament surface with an oil agent for preventing agglutination during the stabilizing and carbonizing steps. This prepares the carbon fiberfree of defects. It is then subjected to surface treatment for improving wettability to plastics. It has now been determined that a carbon fiber of high strength may be obtained by using a suitable precursor, and that the carbon fiber having ruggedness on its surface may improve compatibility to a matrix for giving it full performance in use as a composite material.

As a result of the continued search for obtaining a suitable polyacrylonitrile (PAN) precursor for the carbon fiber from a standpoint other than clothing fibers, it has now been determined that the defects in the clothing fiber, such as devitrification and fibrillization, may have positive advantages for the carbon fiber precursor.

Further, as a result of studying the process for preparing the carbon fiber of high strength in the zinc chloride system, it has now been determined that, without the addition of a non-solvent salt the zinc chloride system together with the lower polymer concentration and the higher draft ratio (in the presence of the non-solvent the lower polymer concentration cannot provide the high draft ratio) may provide a single filament having a diameter of less than 10 μm, and which results in the carbon filament of high strength. In this case, an aperture length/diameter (L/D) ratio of a spinning nozzle of more than 2 may facilitate increase of the draft ratio.

SUMMARY OF THE INVENTION

In view of the foregoing, the invention provides a carbon fiber of high strength, each filament of which is substantially circular in its cross-section and having circumferential ruggedness which extends in parallel to an axis of the filament to form pleats. The filament forms on average more than 10 pleats of such ruggedness which has a depth of more than 0.1 μm from top to bottom of the adjacent pleats.

The carbon fiber of high strength may be prepared, in accordance with the invention, by a process which comprises the steps of extruding from a nozzle a spinning solution of an aqueous polyacrylonitrile/pure zinc chloride solution having a polymer concentration of 1–8% into a coagulating bath at a draft ratio of more than 0.5, followed by washing, drying and stretching at a total stretching ratio of 10–20 to form a precursor having a diameter of not more than 10 μm, which is then subjected to conventional stabilizing and carbonizing treatment.

Preferably, the precursor may be subjected to a relaxing treatment of 5–15% before the stabilizing treatment of more than 30% stretching.

The invention will be described for its preferred embodiment with reference to the accompanying drawing.

PREFERRED EMBODIMENTS OF THE INVENTION

Figure 1:
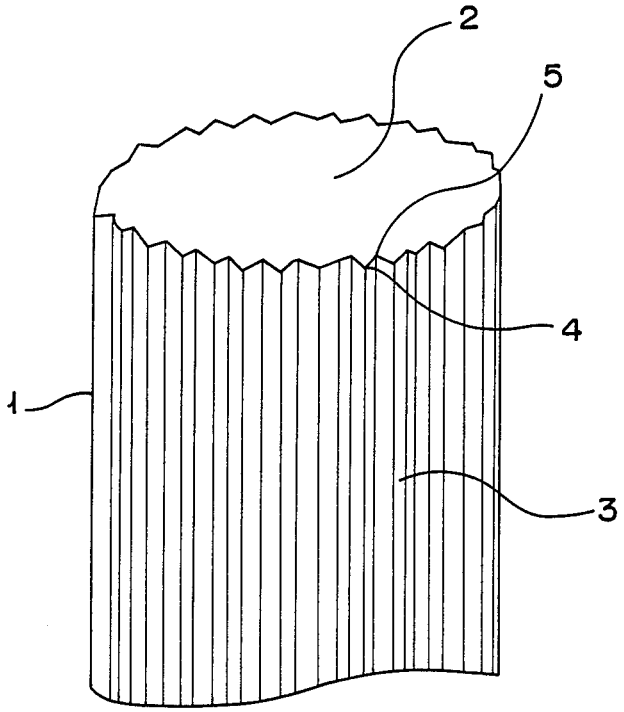
FIG. 1 is an enlarged schematic illustration showing the carbon fiber of high strength prepared according to the invention.

The features of the invention will be described sequentially in more detail.

(1) Aqueous Concentrated Zinc Chloride Solution

An aqueous zinc chloride solution at a concentration of 50–70% is known as a solvent for polyacrylonitrile (PAN), In particular, a concentrated solution of more than 55% can readily dissolve polymers having a molecular weight of about 100,000. It has the ability of stretching the polymeric molecule satisfactorily and bringing the polymeric molecules in an entangled state with each other (namely, representing high viscosity). Incorporation of a non-solvent, such as sodium chloride, of some percentage into the aqueous zinc chloride solution may facilitate reduction of viscosity of the spinning solution, which is employed for preparing the clothing fiber but is not preferable for the process according to the invention.

In other words, such poor solvent cannot stretch the polymeric molecule satisfactorily but dissolves the latter, resulting in a low viscosity. This, less stretched molecule is not preferable for the fiber performance. From this view point, pure zinc chloride having a of not less than 98%, preferably not less than 99% is used. (In general, zinc chloride contains about 1% of ZnO or $Zn(OH)_2$ in the form of Zn(OH)Cl, which should be included in zinc chloride according to the invention. In the invention, as the impurities there may be mentioned compounds comprising cations, such as $Na^+$, $Ca^{++}$, $Cu^{++}$, $Fe^{+++}$or $NH_4^+$, and anions, such as $SO_4^{--}$).

(2) Polymer Concentration

The polymer concentration is usually made as high as possible depending upon the solvent used. This is for economic reasons as well as reduction of the coagulating rate in the coagulating bath. This results in a fiber having a dense structure with less void. In preparation of the precursor for the carbon fiber, there has also been used a high polymer concentration, a low temperature in the coagulating bath and a low draft ratio for spinning in order to obtain the dense fiber structure. However, the carbon filament prepared from such precursor has a graphite structure well-developed only on its surface area but not within the fiber.

In solution polymerization, use of highly pure zinc chloride may provide the maximum polymer concentration of 13% by weight. In accordance with the invention, the polymer concentration of 1–8% by weight (preferably 2–7% by weight) should be used in order to enhance diffusion of the coagulating fluid (aqueous zinc chloride solution of a lower concentration) from the surface area into the inner region of the fiber due to the lower polymer concentration. This prevents uneven structure between the surface area and the inner region. Thus, the reduction of the polymer concentration has the effect of achieving uniform structure both outside and inside the fiber, so that the carbon fiber from such precursor may have a well-developed graphite structure throughout the fiber. This results in high strength.

Another advantage of reducing the polymer concentration is to achieve a smaller diameter of each filament of the carbon fiber. With the spinning condition (extruding rate of the spinning solution, draft ratio, roller speed and others) being constant, variation of the polymer concentration results in different diameters of the filament. For example, the polymer concentration of 4% provides a precursor having a diameter of $1/\sqrt{2}$ compared with the concentration of 8%. The smaller diameter of the precursor may prevent the inhomogeneity of the fiber upon the stabilizing and carbonizing steps, and readily achieve production of a carbon fiber of high strength.

For the reason as described above, the lower polymer concentration may provide the better result, but the concentration below 1% requires a considerably high molecular weight polymer, leading to difficult control and economic disadvantages.

(3) Draft Ratio

The draft ratio represents a measure of the pulling rate during coagulation of the spinning solution in the coagulating bath for forming the fiber. The ratio is calculated by dividing the surface velocity of a first winding roller for receiving the fiber from the nozzle of the coagulating bath by the velocity of the spinning solution from the aperture of the spinning nozzle (linear extruding velocity). The lower draft ratio is said to provide the better result because of less orientation of the fiber in the coagulating bath but with instantaneous orientation in the stretching step. With the low polymer concentration according to the invention, however, the low draft ratio is not desirable because of generation of many voids within the fiber. The higher draft ratio with the low polymer concentration, in comparison with the high polymer concentration, may provide higher orientation of the polymer molecule and thus a higher fibrilling condition, in which the fiber consists of an assembly of many microfilaments and has a uniform structure both outside and inside the fiber. Further, the fiber may have a number of pleats on its circumference due to its microfilament structure, or circumferential ruggedness in its cross-section. When formed into the carbon fiber, the ruggedness may increase the surface area of the fiber, resulting in higher bonding to a matrix and thus higher strength of a composite material.

Further, the higher draft ratio contributes to reduction of the filament diameter. The draft ratio may be selected depending on the nozzle condition and other spinning condition, and is more than 0.5, preferably in the range of 1.0 to 90% of the maximum draft ratio and most preferably in the range of 1.2 to 1.8. The nozzle has preferably an aperture length (L)/aperture diameter (D) ratio of more than 2, wherein the aperture diameter represents the minimum diameter of the nozzle for extruding the spinning solution while the aperture length represents the length of the nozzle section having the minimum diameter. For example, in the case of a nozzle aperture of 120 μm and an L/D ratio of 3, the maximum draft ratio was 2.3. The draft ratio of 1.2 to 1.8 had a significantly better result. (The maximum draft ratio represents the draft ratio at which the fiber is broken due to a higher velocity of the winding roller than the linear extruding velocity from the nozzle.)

Acrylonitrile (PAN) used in the invention may be 100% acrylonitrile but may contain less than 10% of copolymers for improving operability, such as copolymers with α-chloro-acrylonitrile, methacrylonitrile, 2-hydroxyethylacrylonitrile, acrylic acid, methacrylic acid, itaconic acid, crotonic acid, methylacrylate, methylmethacrylate, p-styrene-sulfonic acid, p-styrene-sulfonic ester and others.

The molecular weight of PAN is preferably in the range of 60,000 to 300,000 (according to the Staudinger'viscosity equation) and the higher molecular weight is preferable for the lower polymer concentration (1–3% by weight), while the lower molecular weight is desirable for the higher polymer concentration (5–7% by weight) for keeping a suitable viscosity (30–3000 poise) of the spinning solution.

The spinning solution according to the invention may be prepared directly by solution polymerization or by separately preparing the polymer which is then dissolved in the pure zinc chloride aqueous solution. The former procedure is preferable for dissolving the polymer of high molecular weight, including economic reasons.

In accordance with the invention, the better result is achievable using the following conditions of the coagulating and spinning solution.

* Temperature of the spinning solution is kept below 50° C., preferably in the range of 40° C. to 10° C.
* Zinc chloride concentration in the aqueous coagulating solution is kept in the range of 25–30% by weight.
* Temperature of the coagulating bath is kept below 20° C., preferably below 15° C.

Diffusion of the solvent and coagulating liquid within the fiber is enhanced with these conditions. And, diffusion on the surface of the fiber is inhibited as much as possible for achieving uniformity throughout the fiber.

The fiber leaving the coagulating bath is subjected to the conventional cold stretching, washing, drying and hot stretching steps in the aqueous diluted zinc chloride solution or in water, where the fiber is stretched at a total stretching ratio of about 10–20. Insufficient stretching results in poor orientation of the fibril, low strength of the fiber and a larger diameter of the filament. Stretching of more than 20 folds results in breakage of the fiber and unstable process. The filament as such may be subjected to the stabilizing and carbonizing steps, but preferably subjected to a relaxing treatment at high temperature (steam, hot water or dry hot air) for 5–15% shrinkage in order to improve the subsequent stabilizing treatment.

In accordance with the invention, each filament of the fiber immediately after leaving the coagulating bath has a small diameter, so that the filament (precursor) of a diameter below 10 μm may be obtained by the conventional spinning procedure. The fiber after the relaxing treatment has usually tensile strength of 40–70 Kg/mm$^2$ and elongation of 15–25%.

The precursor of a diameter not more than 10 μm thus formed may be subjected to the conventional stabilizing and carbonizing steps to form the carbon fiber, which process has advantages in that the stabilizing period may be shortened in comparison with the filament of larger diameter, that the readily stretching may be provided during the stabilizing step, that the loosened precursor may be stretched more than 30%, and that the thinner carbon filament may be obtained. Table 1 shows diameters of the precursors filaments, optimum conditions for the stabilizing treatment and performance of the carbon fiber formed.

TABLE 1

| | The Invention | | | Comparison | |
|---|---|---|---|---|---|
| | A | B | C | D | E |
| Diameter of Precursor (μm) | 6 | 7 | 9 | 11 | 13 |
| Optimum Stabilizing Period (min.) *2 | 22 | 23 | 25 | 27 | 30 |
| Elongation During Stabilizing Step (%) | 70 | 60 | 45 | 30 | 25 |
| Diamter of Carbon Filament (μm) *1 | 3.1 | 3.6 | 5.0 | 7.0 | 8.5 |
| Strength of Carbon Fiber (Kg/mm$^2$) | 601 | 556 | 479 | 380 | 353 |
| Modulus of Carbon Fiber (Ton/mm$^2$) | 29.2 | 28.7 | 28.0 | 26.4 | 25.6 |

*1: Diameter of strand in length of 20 cm according to JIS R 7601 (average on N = 4)
*2: value in a stabilizing furnace at 240° C. for the first half and at 260° C. for the second half.

The carbon filament which is formed is thinner than ever, and has ruggedness on its surface, which enables the contact area with the matrix to be enlarged when used as a composite material and thus enhaces shear strength between the fiber and the matrix, as well as tensile strength of the composite material.

As described previously, the ruggedness on each filament surface enlarges the contact area with the matrix and serves as so-called wedges for permitting physical bonding between the fiber and the matrix. For this purpose, an inclination angle from top to bottom of the ruggedness is preferably as steep as possible. Preferably, its depth is also large. Observation of the cross section of 5 mm diameter carbon filament shows that 30–60 tops and the corresponding number of bottoms are present per each filament and that the carbon fiber of high strength having such ruggedness at 10 sites per filament and a depth of more than 0.1 μm, can provide good bonding to the matrix. Especially, the ruggedness at more than 20 sites having a depth of more than 0.1 μm or the ruggedness at more than 2 sites having a depth of 0.3–0.5 μm gave the better bonding to the matrix.

FIG. 1 is an enlarged schematic illustration of the carbon filament of high strength according to the invention, in which numeral reference 3 represents pleats on the filament surface, reference 4 represents tops in cross-section and reference 5 represents bottoms in cross-section.

Table 2 below shows mechanical properties of the carbon fiber when electrolytically surface-treated under identical condition in an aqueous NaOH solution and composited with an epoxy resin.

TABLE 2

| | The Invention | | | Comparison commercial product |
|---|---|---|---|---|
| | B | C | D | |
| Properties of Carbon Fiber | | | | |
| Diameter (μm) | 3.6 | 5.0 | 7.0 | 7 |
| Strength (Kg/mm$^2$) | 556 | 479 | 380 | 350 |
| Modulus (ton/mm$^2$) | 28.7 | 28.0 | 26.4 | 24.3 |
| *A | 32 | 25 | 6 | 3 |
| Mechanical Properties of Composite Material | | | | |
| Content of Carbon Fiber (% by volume) | 57 | 59 | 59 | 58 |
| Tensile Strength (Kg/mm$^2$) | 315 | 266 | 183 | 145 |
| Interlaminar Shear Strength (Kg/mm$^2$) | 13.9 | 13.4 | 9.8 | 9.0 |

*A: Average ruggedness number per filament (on 30 filaments) having depth of more than 0.1 μm.

EXAMPLE 1

Acrylonitrile containing 5% methylacrylate and 2% itaconic acid as comonomers was polymerized in a 60% aqueous solution of pure zinc chloride in a conventional way to provide a spinning solution of 5.5 wt. % polymer content, which had a a molecular weight of 130,000 and a viscosity of 190 poise at 45° C. The spinning solution was extruded from a nozzle having an aperture of 120 μm and aperture number of 9,000 under the following conditions:

Temperature of spinning solution: 30° C.
Temperature of coagulating bath: 7° C.
Zinc chloride content in the aqueous coagulating solution: 29%
Linear extruding velocity: 0.7 m/min.
Draft ratio: 1.4

The fiber was rinsed in water (including cold stretching), stretched in hot water, dried and stretched in steam (vapor pressure 2 Kg/mm$^2$ gauge) and thus provided with a total stretching ratio of 14 folds, and thereafter was wet-relaxed at 90° C. to form a precursor which had a diameter of 8.2 μm, tensile strength of 56 Kg/mm² and elongation of 21%.

The precursor thus formed was passed through a stabilizing furnace at 240° C. for the first half and at 260° C. for the second half over a period of 24 minutes with elongation of 50%.

Then, the precursor was passed through a carbonizing furnace within 5 minutes, which had previously been heated to 1300° C. under pure nitrogen atmosphere, to form a carbon fiber which was then surface-treated by applying an electric current of 5 V, 50 mA to the fiber in 10% aqueous NaOH solution. The carbon filament thus treated had a diameter of 4.6 μm, tensile strength of 502 Kg/mm² and modulus of 28.6 ton/mm². Further, each carbon filament had ruggedness at 32 sites on average having a depth of more than 0.1 μm, and at 5 sites on average having a depth more than 0.3 μm, as measured for 30 filaments on their cross-section by a scanning electromicroscope. A composite material of the carbon fiber with an epoxy resin had a fiber content of 56 vol. %, tensile strength of 275 Kg/mm² and interlaminar shear strength of 13.0 Kg/mm².

EXAMPLE 2

The spinning stock as prepared in Example 1 was added to a 60% aqueous solution of pure zinc chloride to form a spinning solution having a polymer content of 4.5% and a viscosity of 85 poise at 45° C.

The spinning solution thus formed was spinned under the same condition as in Example 1 to obtain a precursor having a diameter of 7.4 μm, a tensile strength of 59 Kg/mm² and elongation of 22%.

The precursor was passed through the stabilizing furnace at 240° C. for the first half and at 260° C. for the second half over a period of 23 minutes with stretching of 55%, and then carbonized at 1300° C. for 5 minutes. It was further surface-treated in 10% aqueous NaOH solution to form a carbon filament which had a diameter of 3.9 μm, tensile strength of 521 Kg/mm² and modulus of 28.2 ton/mm². Just as was observed in Example 1 for 30 filaments, each filament in this Example had the ruggedness at 34 sites on average having a depth of more than 0.1 μm and at 11 sites on average having a depth of more than 0.3 μm. A composite material of the carbon fiber with an epoxy resin had a fiber content of 55 vol. %, tensile strength of 271 Kg/mm² and interlaminar shear strength of 13.3 Kg/mm².

EXAMPLE 3

Acrylonitrile containing 4% methylacrylate and 1% itaconic acid as comonomers was polymerized in 62% aqueous solution of pure zinc chloride in the conventional way to form a spinning solution having a molecular weight of 190,000, a polymer content of 3.5% and a viscosity of 110 poise at 45° C.

The spinning solution was extruded from a nozzle having an aperture of 120 μm and aperture number of 3,000 under the following conditions:

Temperature of spinning solution: 25° C.
Temperature of coagulating bath: 2° C.
Zinc chloride content in coagulating solution: 28%
Linear extruding velocity: 0.8 m/min.
Draft ratio: 1.25

The fiber was rinsed in water (including cold stretching), stretched in hot water, dried and then steam-stretched (vapor pressure 1.8 Kg/mm² gauge) to provide a total stretching ratio of 15 folds. Thereafter, the fiber was wet-relaxed at 95° C. to form a precursor having a diameter of 6.3 μm, tensile sterngth of 70 Kg/mm² and elongation of 23%. The precursor was then passed through a stabilizing furnace at 235° C. for the first half and at 255° C. for the latter half over a period of 23 minutes with stretching of 65%, and then carbonized at 1,300° C. for 3 minutes and further surface-treated to form a carbon filament having a diameter of 3.4 μm, tensile strength of 578 Kg/mm² and tensile modules of 28.9 ton/mm². A composite material of the carbon fiber with an epoxy resin had a fiber content of 56 vol. %, tensile strength of 304 Kg/mm², tensile modulus of 15.7 ton/mm² *and interlaminar shear strength of* 13.8 Kg/mm².

Comparative Examples 1 to 4

Comparative carbon fibers were prepared from precursors formed under the indicated conditions in comparison with Example 1 and are shown for their performance in Table below.

| | Comp. Ex. 1 | Comp. Ex. 2 | Comp. Ex. 3 | Comp. Ex. 4 | Ex. 1 |
|---|---|---|---|---|---|
| Monomer Composition | same as in Ex. 1 | " | " | " | — |
| Polymer Content (%) | 0.5 | 9.0 | 5.5 | 6.5 | 5.5 |
| Draft Ratio | 0.6 | 1.2 | 0.4 | 1.5 | 1.4 |
| Total Stretching Ratio | 13 | 11 | 17 | 8 | 14 |
| Filament Diameter of Precursor (μm) | 3.4 | 12.8 | 14.0 | 11.5 | 8.2 |
| Tensile Strength of Carbon Fiber (Kg/mm²) | 308 | 362 | 388 | 376 | 502 |
| Modulus (ton/mm²) | 25.2 | 25.8 | 24.3 | 25.9 | 28.6 |

In accordance with the invention, the carbon fiber of high strength may be obtained and the composite material having superior mechanical properties may also be prepared therefrom.

What is claimed is:

1. A process for preparing a carbon fiber of high strength, which comprises the steps of:

(a) extruding from a nozzle a spinning solution of an aqueous polyacrylonitrile/pure zinc chloride solution having a polymer concentration of 1 to 8% into a coagulating bath at a draft ratio of more than 0.5, said spinning solution being kept at a temperature below 50° C., said coagulating bath being kept at a temperature below 20° C., and with a zinc chloride content of 25–30% by weight in the aqueous coagulating solution;

(b) washing, drying and stretching for setting a total stretching ratio of 10–20 to form a precursor having a diameter of not more than 10 μm; and (c) stabilizing and carbonizing the precursor, said stabilizing comprising a stretching of more than 30%, thereby providing circumferential ruggedness of at least 10 pleats per filament on a surfacee of the carbon fiber after said carbonizing treatment, said ruggedness extending in parallel to an axis of the carbon fiber and having a depth of more than 0.1 μm.

2. A process according to claim 1, wherein the precursor is subjected to a relaxing treatment of 5–15% before said stretching of more than 30%.

3. A process according to claim 1, wherein the nozzle has an aperture length (L)/aperture diameter (D) ratio of more than 2, through which nozzle the spinning solution is extruded into the coagulating bath at a total nozzle draft ratio of more than 0.5.

* * * * *